US006176569B1

(12) United States Patent
Anderson et al.

(10) Patent No.: US 6,176,569 B1
(45) Date of Patent: Jan. 23, 2001

(54) TRANSITIONAL INK JET HEATER ADDRESSING

(75) Inventors: Frank Edward Anderson, Sadieville; Bruce David Gibson, Lexington; George Keith Parish, Winchester; Thomas Jon Eade, Lexington, all of KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/368,666

(22) Filed: Aug. 5, 1999

(51) Int. Cl.[7] ..... B41J 2/05
(52) U.S. Cl. ..... 347/57; 347/59
(58) Field of Search ..... 347/57–59, 12, 347/13, 55, 62

(56) References Cited

U.S. PATENT DOCUMENTS

| | | | | |
|---|---|---|---|---|
| 4,216,481 | | 8/1980 | Hakoyama | 347/182 |
| 4,395,146 | | 7/1983 | Arai | 347/182 |
| 4,510,509 | | 4/1985 | Horike et al. | 347/55 |
| 4,536,771 | | 8/1985 | Tanaka | 347/182 |
| 4,675,700 | | 6/1987 | Nagira et al. | 347/182 |
| 4,873,535 | | 10/1989 | Sasaki | 347/182 |
| 4,952,085 | | 8/1990 | Rein | 347/182 |
| 4,973,984 | | 11/1990 | Sasaki | 347/182 |
| 5,142,296 | | 8/1992 | Lopez et al. | 347/12 |
| 5,157,411 | | 10/1992 | Takekoshi et al. | 347/13 |
| 5,173,717 | * | 12/1992 | Kishida et al. | 347/13 |
| 5,266,965 | | 11/1993 | Komai et al. | 347/12 |
| 5,359,352 | | 10/1994 | Saita et al. | 347/62 |
| 5,412,405 | | 5/1995 | Nureki et al. | 347/182 |
| 5,428,380 | | 6/1995 | Ebisawa | 347/35 |
| 5,442,381 | | 8/1995 | Fukubeppu et al. | 347/182 |
| 5,451,988 | | 9/1995 | Ono | 347/185 |

(List continued on next page.)

*Primary Examiner*—John Barlow
*Assistant Examiner*—Juanita Stephens
(74) *Attorney, Agent, or Firm*—Luedeka, Neely & Graham; Michael T. Sanderson

(57) ABSTRACT

An apparatus addresses ink jet heating elements based on image data to cause ejection of ink droplets toward a print medium. The apparatus includes a controller for generating address signals, power signals, and first and second bank signals. The first and second bank signals, which are carried on first and second bank lines, alternate between on and off states. The first bank signal is off when the second bank signal is on, and the second bank signal is off when the first bank signal is on. The apparatus has m address lines and n power lines connected to the controller for carrying the address signals and the power signals. A print head has m×n number of first driver circuits, each of which is connected to the first bank line and to a corresponding one of the m address lines. The first driver circuits enable flow of a first driving current when the first bank signal and the address signal are simultaneously on on the first bank line and the corresponding address line. The print head has m×n number of second driver circuits, each of which is connected to the second bank line and to a corresponding one of the m address lines. The second driver circuits enable flow of a second driving current when the second bank signal and the address signal are simultaneously on on the second bank line and the corresponding address line. First heating elements are each connected to a corresponding one of the first driver circuits and to one of the n power lines. A first heating element is activated by the first driving current when the power signal is on on the connected power line and the corresponding first driver circuit enables flow of the first driving current. Second heating elements are each connected to a corresponding one of the second driver circuits and to one of the n power lines. A second heating element is activated by the second driving current when the power signal is on on the connected power line and the corresponding second driver circuit enables flow of the second driving current.

9 Claims, 4 Drawing Sheets

U.S. PATENT DOCUMENTS

| | | | | |
|---|---|---|---|---|
| 5,519,417 | * | 5/1996 | Stephany et al. | 347/57 |
| 5,541,629 | | 7/1996 | Saunders et al. | 347/12 |
| 5,550,568 | | 8/1996 | Misumi | 347/12 |
| 5,635,968 | * | 6/1997 | Bhaskar et al. | 347/159 |
| 5,724,077 | * | 3/1998 | Murata | 347/12 |
| 5,734,398 | | 3/1998 | Mitani | 347/57 |
| 5,754,193 | | 5/1998 | Elhatem | 347/12 |

* cited by examiner

TRANSITIONAL INK JET HEATER ADDRESSING

FIELD OF THE INVENTION

The present invention is generally directed to ink jet printers. More particularly, the present invention is directed to a three-dimensional ink jet heater addressing scheme.

BACKGROUND OF THE INVENTION

As the printing resolution of ink jet printers increases, so does the number of nozzles on the ink jet print head. For each nozzle used to eject ink to form printed pixels on the print medium, there is a corresponding heating element. As nozzles counts have increased, driver circuitry has been incorporated on the print head substrate along with the heating elements. The driver circuitry activates the heating elements in a time-multiplexed fashion, with combinations of power and address lines being used to select the heating element or elements to be activated. For example, in a 208-nozzle print head, there may be sixteen power lines and 13 address lines for a total of 29 signal lines used to activate 208 heating elements. (16×13=208).

In a typical ink jet printer design having a print head that scans across the print medium, each of the signal lines generally must be brought from a printer controller to the print head through a flexible cable. Also, there must be an interconnection, such as a bonding pad on the print head for each signal line that connects to the driver circuitry on the print head substrate. In a low-cost ink jet printer design, the cost of such interconnects, and the cost of print head drivers, and can be quite significant. A reduction in signal lines would simplify the design and reduce the cost of printers and print heads. Further, reducing the number of signal lines would allow more flexibility in possible design configurations.

Therefore, a heating element addressing scheme is needed that reduces the number of signals lines connecting the print head to the printer controller.

SUMMARY OF THE INVENTION

The foregoing and other needs are met by an apparatus for receiving image data representing an image to be printed on a print medium, and for addressing ink jet heating elements based on the image data to cause ejection of ink droplets from ink jet nozzles toward the print medium. The apparatus includes a controller for generating electrical signals based on the image data. The electrical signals generated by the controller include address signals, power signals, and first and second bank signals. The controller determines an on or off state for each of the electrical signals depending on the image data. The controller alternates the first and second bank signals between on and off states, where the first bank signal is off when the second bank signal is on, and where the second bank signal is off when the first bank signal is on.

The apparatus also includes a first bank line connected to the controller for carrying the first bank signal, and a second bank line connected to the controller for carrying the second bank signal. The apparatus has address lines connected to the controller for carrying the address signals, where m represents the number of address lines. Power lines are connected to the controller for carrying the power signals, where n represents a number of power lines.

The apparatus includes a print head having first and second driver circuits. Each of the first driver circuits is connected to the first bank line and to a corresponding one of the m address lines. The first driver circuits enable flow of a first driving current when the first bank signal and the address signal are simultaneously in an on state on the first bank line and the corresponding address line. Each of the second driver circuits is connected to the second bank line and to a corresponding one of the m address lines. The second driver circuits enable flow of a second driving current when the second bank signal and the address signal are simultaneously in an on state on the second bank line and the corresponding address line. The print head includes m×n number of first driver circuits and m×n number of second driver circuits.

The print head also has first heating elements, each of which is connected to a corresponding one of the first driver circuits and to one of the n power lines. A particular one of the first heating elements is activated by the first driving current when the power signal is in an on state on the connected power line and the corresponding one of the first driver circuits enables flow of the first driving current. The print head includes second heating elements, each of which is connected to a corresponding one of the second driver circuits and to one of the n power lines. A particular one of the second heating elements is activated by the second driving current when the power signal is in an on state on the connected power line and the corresponding one of the second driver circuits enables flow of the second driving current. The print head has m×n number of first heating elements and m×n number of second heating elements.

By introducing the first and second bank signals in a third dimension of heating element addressing, the present invention provides an addressing scheme that significantly reduces the number of power lines as compared to a conventional two-dimensional addressing scheme. A typical two-dimensional addressing scheme requires twice the number of power lines as does the present invention. Since signal lines and their interconnections to the print head represent a significant portion of the cost in a low-cost ink jet printer, the present invention offers significant cost advantages.

In another aspect, the invention provides a method for receiving image data and activating ink jet heating elements based on the image data to cause ejection of ink droplets from ink jet nozzles toward a print medium. The heating elements to which the method applies comprise odd heating elements in a first bank and even heating elements in an second bank. The method includes the step of generating m number of address signals which are periodically in on and off states, and n number of power signals which are in on or off states depending on the image data. Each one of the n power signals is provided to a corresponding one of n number of power groups of heating elements, where each power group includes m number of even heating elements and m number of odd heating elements. A first bank signal and a second bank signal are generated in alternating on and off states, where the first bank signal is in an off state when the second bank signal is in an on state, and the second bank signal is in an off state when the first bank signal is an on state. A first current path is provided for flow of a first driving current when the first bank signal and one of the address signals are simultaneously in an on state. The method includes causing the first driving current to flow through the first current path when the first current path is provided and one of the n number of power signals is in an on state. One of the odd heating elements is activated by the flow of the first driving current. Similarly, a second current path is provided for flow of a second driving current when the second bank signal and one of the address signals are simultaneously in an on state. The method includes causing the second driving current to flow through the second current path when the second current path is provided and one of the n number of power signals is in an on state. One of the even heating elements is activated by the flow of the second driving current.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
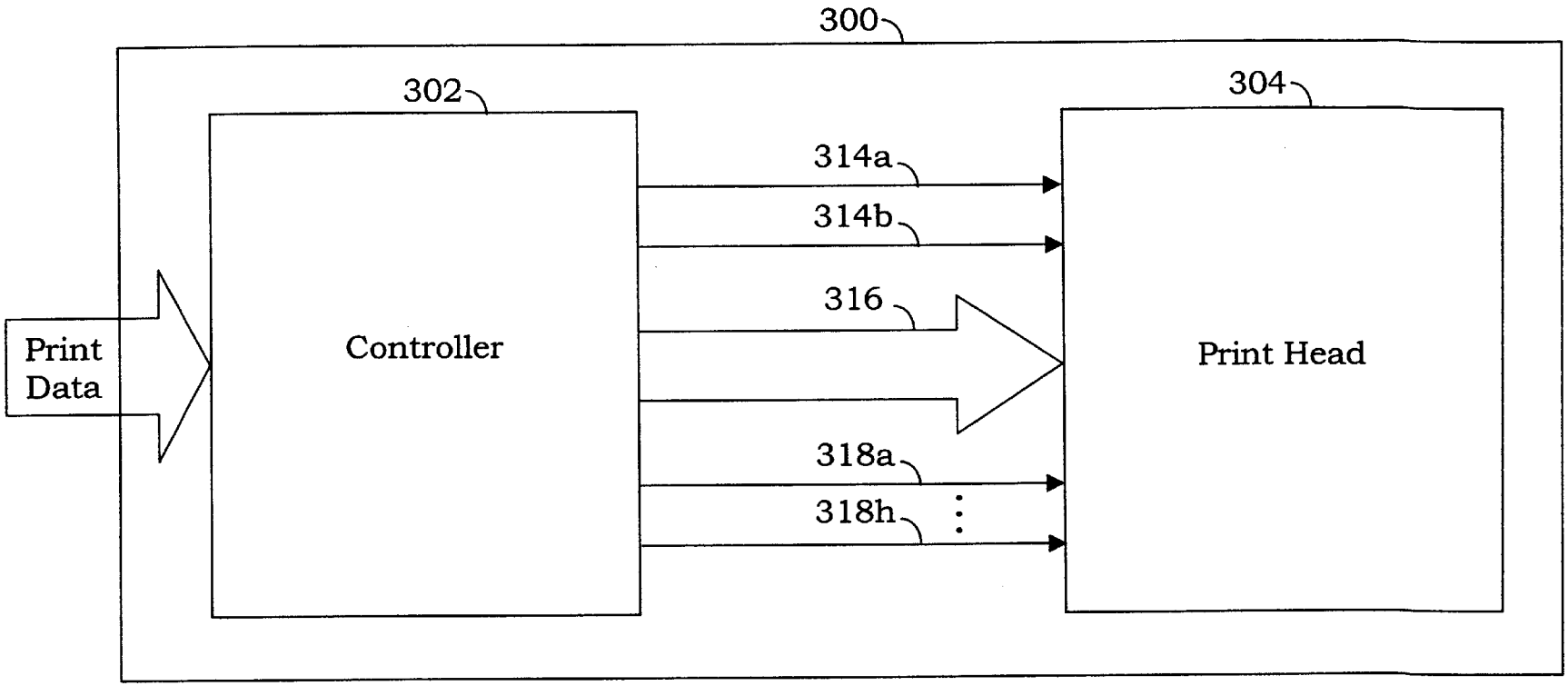
FIG. 1 is a functional block diagram of an ink jet printer that implements a heating element addressing scheme according to a preferred embodiment of the present invention.

Shown in FIG. 1 is a functional block diagram of an ink jet printer 300 that implements a heating element addressing scheme according to the present invention. The printer 300 includes a controller 302, such as a digital microprocessor, that receives print data from a host computer (not shown). The print data includes digital information describing an image to be printed on a print medium. Based on the print data, the controller 302 generates control signals for controlling the operation of an ink jet print head 304.

The control signals include first and second bank signals that are transferred from the controller 302 to the print head 304 on first and second bank control lines 314*a* and 314*b*. The control signals also include address signals that are transferred over an address bus 316. In a preferred embodiment of the invention, there are thirteen address lines 316*a*–316*m* in the address bus 316. Power signals are transferred from the controller 302 to the print head 304 via power lines 318. The preferred embodiment includes eight power lines 318*a*–318*h*. To simplify FIG. 1, only two of the power lines 318*a* and 318*h* are shown.

Figure 2:
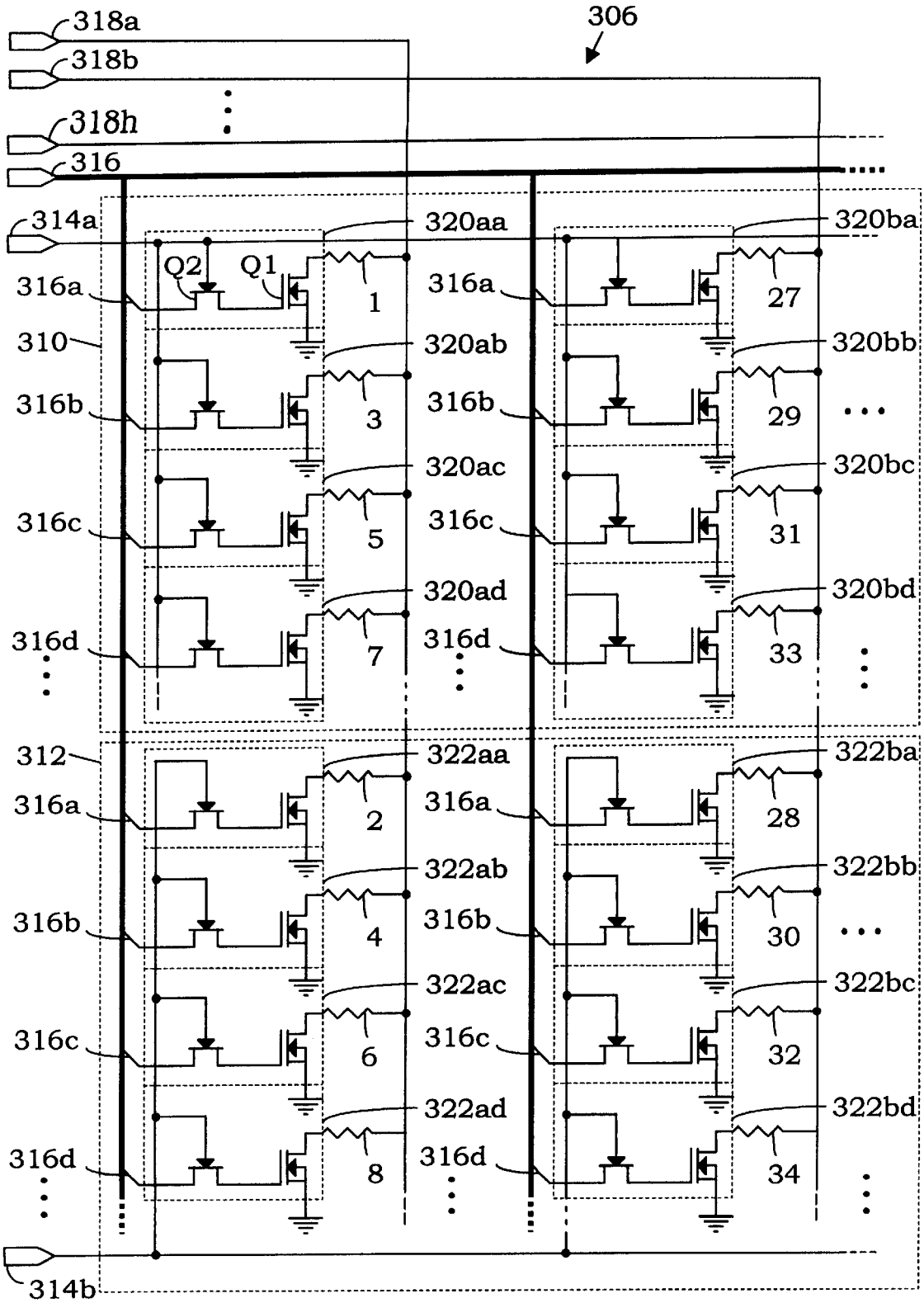
FIG. 2 is a schematic diagram of a heating element addressing circuit according to a preferred embodiment of the invention.

FIG. 2 shows a preferred embodiment of a heating element addressing circuit 306 in the print head 304. The addressing circuit 306 is generally divided into two sections or banks, a first or odd bank 310, and a second or even bank 312. The first bank 310 includes 104 first driver circuits 320*aa*–320*hm* and the second bank includes 104 second driver circuits 322*aa*–322*hm*. To simplify FIG. 2, only eight of the first driver circuits 320*aa*–320*ad* and 320*ba*–320*bd*, and eight of the second driver circuits 322*aa*–322*ad* and 322*ba*–322*bd* are represented. It should be appreciated that nine more first driver circuits 320*ae*–320*am*, though not depicted in FIG. 2, are connected in sequence below the first driver circuits 320*aa*–320*ad* in the same manner as those shown. Similarly, nine more first driver circuits 320*be*–320*bm* are connected in sequence below the first driver circuits 320*ba*–320*bd*. Though not shown in FIG. 2, the circuit structure repeats to the right, with six more columns of first driver circuits 320*ca*–320*cm*, 320*da*–320*dm*, 320*ea*–320*em*, 320*fa*–320*fm*, 320*ga*–320*gm*, and 320*ha*–320*hm* included in the first bank 310. In similar fashion, nine more second driver circuits 322*ae*–322*am* are connected in sequence below the second driver circuits 322*aa*–322*ad* in the same manner as those shown. Likewise, nine more second driver circuits 322*be*–322*bm* are connected in sequence below the second driver circuits 322*ba*–322*bd*. The circuit structure of the second bank 312 also repeats to the right, with six more columns of second driver circuits 322*ca*–322*cm*, 322*da*–322*dm*, 322*ea*–322*em*, 322*fa*–322*fm*, 322*ga*–322*gm*, and 322*ha*–322*hm*.

As described in more detail hereinafter, the addressing circuit 306 receives the control signals from the controller 304 and, based on the control signals, selectively activates one or more heating elements which are arranged on a semiconductor substrate within the print head 304. Each heating element consists of an area of electrically resistive material, such as TaAl, which produces heat as an electrical current passes through. When activated, the heating elements cause ink to be ejected onto the print medium to form a printed image.

The preferred embodiment of the invention includes 208 heating elements, referenced herein by reference numbers 1–208. To avoid overly complicating FIG. 2, only sixteen of the heating elements are shown (1–8 and 27–34). Though not shown, nine more heating elements 9–25 are connected in sequence below elements 1–7, and nine more elements 35–51 are connected in sequence below elements 27–33. Also, nine more elements 10–26 are connected in sequence below elements 2–8, and nine more elements 36–52 are connected in sequence below elements 28–34. Further, though not shown, there are preferably six more columns of heating elements in the first bank 310 and six more columns of heating elements in the second bank 312 to right of the two columns shown in FIG. 2. Those six columns in the first bank 310 include odd-numbered heating elements 53–207, and in the second bank include even-numbered heating elements 54–208. Hereinafter, the odd-numbered heating elements 1–207 are also referred to as the first heating elements 1–207, and the even-numbered heating elements 2–208 are also referred to as the second heating elements 2–208.

Figure 3:
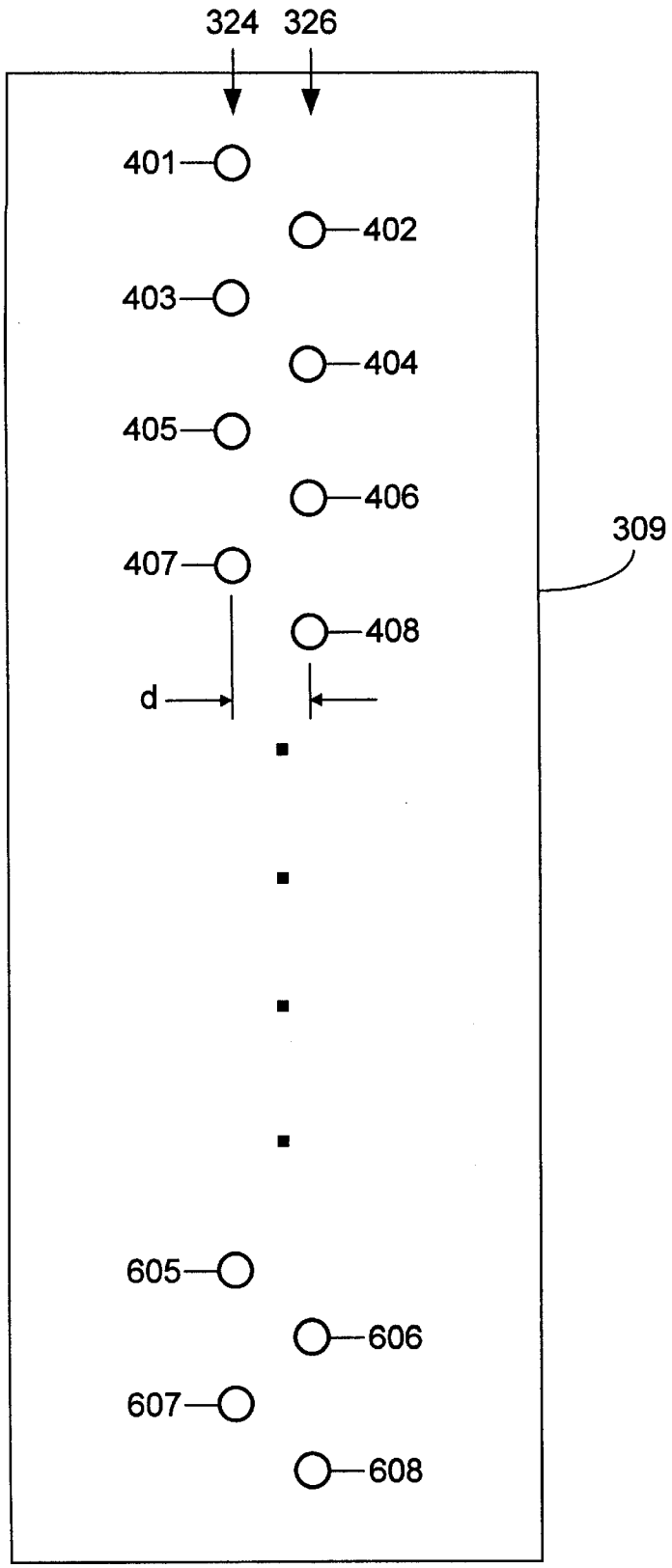
FIG. 3 depicts ink jet nozzles on a nozzle plate according to a preferred embodiment of the invention.

As shown in FIG. 3, a nozzle plate 309 on the print head 304 contains an array of nozzles 401–608. Each of the nozzles 401–608 in the nozzle plate 309 is located adjacent to a corresponding heating element 1–208 in the substrate. Preferably, the nozzles 401–608 and the corresponding heating elements 1–208 are arranged in two parallel vertical columns, including a first column 324 and a second column 326. As FIG. 3 indicates, the first column 324 is slightly offset in the horizontal direction from the second column 326 by a distance d. In the first column 324 are the odd-numbered nozzles 401–607 and the corresponding first heating elements 1–207, and in the second column 326 are the even-numbered nozzles 402–608 and the corresponding second heating elements 2–208.

In the preferred embodiment depicted in FIG. 2, each of the first and second driver circuits 320*aa*–320*hm* and 322*aa*–322*hm* includes a power transistor Q1, such as a MOSFET device, and an addressing transistor Q2, such as a JFET device. As shown in FIG. 2, the gate of each addressing transistor Q2 in the first driver circuits 320*aa*–320*hm* is connected to the first bank line 314*a*. When the bank signal on the first bank line 314*a* is in an on state, the transistors Q2 of the first driver circuits 320*aa*–320*hm* are conductive between their source and drain. Thus, the transistors Q2 act like switches that are closed when the first bank signal is on, and that are open when the first bank signal is off.

The drain of each transistor Q2 is connected to a corresponding one of the thirteen address lines 316*a*–316*m*. The source of each transistor Q2 is connected to the gate of each transistor Q1. As discussed above, when the first bank signal is on, each transistor Q2 of the first driver circuits 320*aa*–320*hm* acts like a closed switch, thus connecting the corresponding address lines 316*a*–316*m* to the gate of the transistors Q1. If the first bank signal is on and the address signal on the corresponding address line 316*a*–316*m* is on, then the transistor Q1 is conductive between its source and drain. Consequently, when the first bank signal and the corresponding address signal are both on, the transistor Q1 acts like a closed switch between its source and drain.

As shown in FIG. 2, the drain of the transistor Q1 in each of the first driver circuits 320*aa*–320*hm* is connected to one side of the first heating elements 1–207, and the source of the transistor Q1 is grounded. The other side of each first heating element 1–207 is connected to one of the power lines 318*a*–318*h*. In the preferred embodiment, the first heating elements 1–25 are connected to the power line 318*a*, the first heating elements 27–51 are connected to the power line 318*b*, and so forth. The thirteen first heating elements connected to one of the power lines comprise half of a power group. As discussed below, the thirteen second heating elements connected to the same power line comprise the other half of the power group. Thus, in the preferred embodiment, there are eight power groups corresponding to the eight power lines 318*a*–318*h*.

Referring to FIG. 2, a first current flows through the first heating element 1 if three conditions are simultaneously met: (1) the power signal is an on state on the power line 318*a*, (2) the first bank signal is in an on state on the first bank line 314*a*, and (3) the address signal is in an on state on the address line 316*a*. Thus, a particular first heating element 1–207 is activated only when its corresponding power signal, address signal, and first bank signal is on. Since there is a corresponding address line 316*a*–316*m* for each of the first heating elements in a power group, each of the first heating elements is individually addressable.

The above discussion regarding the addressing scheme for the first heating elements 1–207 is equally applicable to the addressing of the second heating elements 2–208 with the only difference being that the second driver circuits 322*aa*–322*hm* are connected to the second bank line 314*b* instead of the first bank line 314*a*. As shown in FIG. 2, the second heating elements 2–26 are connected to the same power line 31 8*a* as the first heating elements 1–25, the second heating elements 28–52 are connected to the same power line 318*b* as the first heating elements 27–51, and so forth. The same thirteen address lines 316*a*–316*m* are connected to the second driver circuits 322*aa*–322*hm*. Thus, any one of the second heating elements 2–208 may be activated when the second bank signal and the corresponding power and address signals are simultaneously in an on state.

Figure 4:
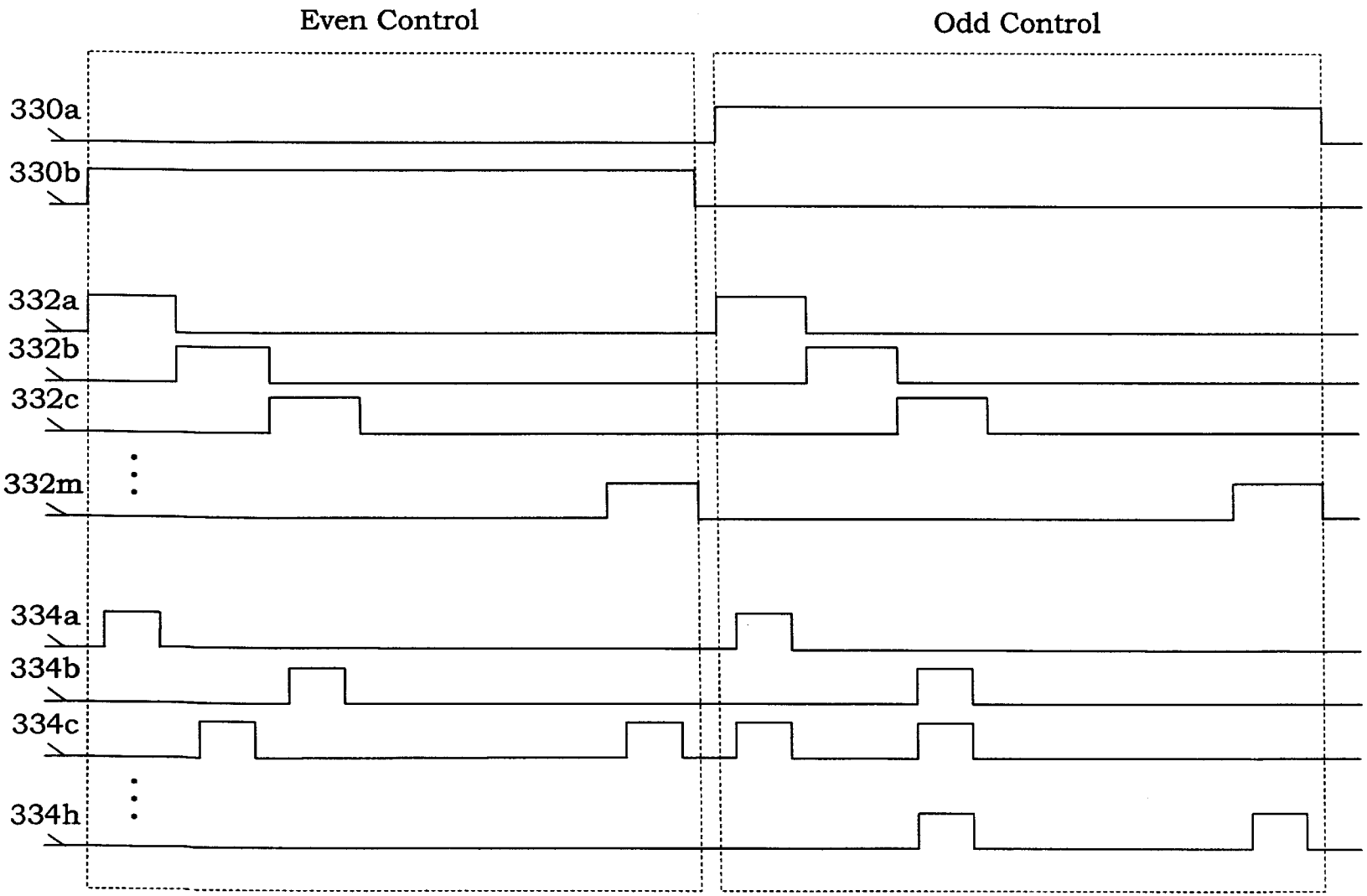
FIG. 4 is a timing diagram of control signals produced by a printer controller according to a preferred embodiment of the invention.

FIG. 4 is an exemplary timing diagram showing the first and second bank signals 330*a* and 330*b*, address signals 332*a*–332*m*, and power signals 334*a*–334*h* generated by the printer controller 302 according to a preferred embodiment of the invention. In an even control time period, the controller 302 turns on the second bank signal 330*b* and turns off the first bank signal 330*a*, so that only the second heating elements 2–208 are addressable during the even control time period. During the even control time period, the controller 302 sequentially turns on and then off each of the thirteen address signals 332*a*–332*m*, as shown in FIG. 4. Following the even control time period is an odd control time period during which the controller 302 turns off the second bank signal 330*b* and turns on the first bank signal 330*a*. Thus, only the first heating elements 1–207 are addressable during the odd control time period. The controller 302 again sequentially turns on and then off each of the thirteen address signals 332*a*–332*m* during the odd control time period. In this manner, all of the nozzles 401–608 can be fired once during the combination of the even and odd control periods to form a vertical column of pixels on the print medium.

As shown in the example of FIG. 4, during the even control period, the controller 302 pulses on the power signal 334*a* while the address signal 332*a* is on. This combination of signals activates the second heating element 2 (see FIG. 2) and causes an ink droplet to be expelled from the nozzle 402. Next, the controller 302 turns on the power signal 334*c* while the address signal 332*b* is on, thus activating the second heating element 56. While the address signal 332*c* is on, the controller 302 turns on the power signal 334*b* to activate the second heating element 32 (see FIG. 2). At the end of the even control period, when the address signal 332*m* is on, the controller 302 turns on the power signal 334*c* to activate the second heating element 77.

Continuing with the example of FIG. 4, while the address signal 332*a* is on during the odd control period, the controller 302 turns on the power signal 334*a* to activate the first heating element 1. At the same time, the controller 302 turns on the power signal 334*c* to activate the first heating element 53. Thus, first heating elements 1 and 53 are activated simultaneously. According to FIG. 4, no heating elements are activated while the address signal 332*b* is on during the odd control period. Next, the controller 302 turns on the power signals 334*b*, 334*c*, and 334*h* while the address signal 332*c* is on, thus simultaneously activating the first heating elements 31, 57, and 187.

As the example of FIG. 4 illustrates, heating elements that are in the same power group, that is, heating elements connected to the same power line 318*a*–318*h*, cannot be activated simultaneously. For example, no two of the first or second heating elements 1–26 connected to the power line 318*a* may be activated simultaneously. Only heating elements that are in different power groups may be activated at the same time. This feature of the invention maintains consistent power dissipation from element to element as the heating elements are activated.

As discussed above, the even-numbered nozzles 402–608 are fired and then the odd-numbered nozzles 401–607 are fired to form a column of pixels as the print head translates across the paper. As shown in FIG. 3, the offset distance d between the first and second columns 324 and 326 accommodates the time delay between the firings of the even and odd nozzles so that the pixels printed by the odd and even nozzles line up vertically in the column.

One skilled in the art will appreciate that the present invention significantly reduces the number of power lines and power drivers as compared to an addressing scheme which has no even/odd bank control. For example, the preferred embodiment of the present invention addresses 208 heating elements using eight power lines, thirteen address lines, and two bank lines, for a total of 23 signal lines. A conventional two-dimensional addressing scheme using thirteen address lines would require twice the number of power lines and power drivers. Thus, the two-dimensional scheme would require a total of 29 signal lines (13 address lines+16 power lines). Therefore, the preferred embodiment of the invention reduces the number of signal lines and drivers by six. As noted above, since signal lines and their interconnections to the print head represent a significant portion of the cost in a low-cost ink jet printer, the present invention offers significant cost advantages over prior addressing schemes. Further, for each signal line eliminated between the controller 302 and print head 304, there is a corresponding reduction in the number of bonding pads needed on the print head 304. This reduces the cost of the print head chip and offers more flexibility in print head wiring design.

It will be appreciated that the invention is not limited to any particular number of bank, address, and signal lines. For example, instead of a single even bank line and a single odd bank line as described above in the preferred embodiment, there could be two even and two odd bank lines, for a total of four bank lines. Accordingly, while maintaining eight power lines, the number of address lines may be reduced to seven. With this embodiment, 224 heating elements (4×7×8=224) are addressable using nineteen signal lines (4+7+8=19).

The disclosed design offers additional wiring advantages in print heads that use redundant heating elements. Normally, power line groups of heating elements are located on opposing sides of the print head. This arrangement requires that the power lines be bussed from one side of the chip to the other, resulting in overlapping conductor traces and vias. Implementation of the invention simplifies power line wiring by putting power line groups of heating elements on only one side of the chip. Since vias, crossing conductors, and horizontally-bussed power lines are eliminated, the invention reduces overall power line trace resistance by as much as 3.5 ohms in the preferred embodiment.

Those skilled in the art will appreciate that the invention is not limited by any particular number of heating elements on the print head 304. The 208-element print head 304 described herein is exemplary, and not limiting. Those skilled in the art will also appreciate that other types of driver circuits could be implemented within the scope of the invention. For example, combinational logic circuits could be used in place of the transistors Q1 and Q2 shown in FIG. 2.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An apparatus for receiving image data and activating ink jet heating elements based on the image data to cause ejection of ink droplets from ink jet nozzles toward a print medium, the image data representing an image to be printed on the print medium, the apparatus comprising:

a controller for generating a plurality of electrical signals based on the image data, the electrical signals including address signals, power signals, and bank signals, the controller determining an on or off state for each of the electrical signals depending on the image data, the controller causing each of the bank signals to sequentially be in an on state while every other bank signal is in an off state, such that only one of the bank signals is in an on state at any given time;

bank lines connected to the controller for carrying the bank signals, where k represents a number of bank lines;

address lines connected to the controller for carrying the address signals, where m represents a number of address lines;

power lines connected to the controller for carrying the power signals, where n represents a number of power lines; and a print head comprising:

driver circuits, each of which is connected to a corresponding one of the k bank lines and to a corresponding one of the m address lines, where each of the driver circuits enables flow of a driving current when the bank signal and the address signal are simultaneously in an on state on the corresponding bank line and the corresponding address line, there being k×m×n number of driver circuits; and heating elements, each of which is connected to a corresponding one of the driver circuits and to one of the n power lines, where a particular one of the heating elements is activated by the driving current when the power signal is in an on state on the connected power line and the corresponding one of the driver circuits enables flow of the driving current, there being k×m×n number of heating elements.

2. The apparatus of claim 1 further comprising:

the controller further for generating first and second bank signals, and for alternating the first and second bank signals between on and off states, where the first bank signal is off when the second bank signal is on, and where the second bank signal is off when the first bank signal is on;

the bank lines further comprising:

a first bank line connected to the controller for carrying the first bank signal; and a second bank line connected to the controller for carrying the second bank signal; and the print head further comprising:

first driver circuits, each of which is connected to the first bank line and to a corresponding one of the m address lines, where each of the first driver circuits enables flow of a first driving current when the first bank signal and the address signal are simultaneously in an on state on the first bank line and the corresponding address line, there being m×n number of first driver circuits;

second driver circuits, each of which is connected to the second bank line and to a corresponding one of the m address lines, where each of the second driver circuits enables flow of a second driving current when the second bank signal and the address signal are simultaneously in an on state on the second bank line and the corresponding address line, there being m×n number of number of second driver circuits;

first heating elements, each of which is connected to a corresponding one of the first driver circuits and to one of the n power lines, where a particular one of the first heating elements is activated by the first driving current when the power signal is in an on state on the connected power line and the corresponding one of the first driver circuits enables flow of the first driving current, there being m×n number of first heating elements; and second heating elements, each of which is connected to a corresponding one of the second driver circuits and to one of the n power lines, where a particular one of the second heating elements is activated by the second driving current when the power signal is in an on state on the connected power line and the corresponding one of the second driver circuits enables flow of the second driving current, there being m×n number of second heating elements.

3. The apparatus of claim 1 where k is two.

4. The apparatus of claim 1 where m is thirteen.

5. The apparatus of claim 1 where n is eight.

6. A method for receiving image data and activating ink jet heating elements based on the image data to cause ejection of ink droplets from ink jet nozzles toward a print medium, the method including the steps of:

generating m number of address signals, each of the address signals being periodically in on and off states;

generating n number of power signals, each of the power signals being in an on or off state depending on the image data;

providing each one of the n power signals to a corresponding one of n number of power groups of heating elements;

generating k number of bank signals, each one of the bank signals being sequentially in an on state while every other bank signal is in an off state, such that only one of the bank signals is in an on state at any given time;

providing a current path for flow of a driving current when one of the bank signals and one of the address signals are simultaneously in an on state;

causing the driving current to flow through the current path when the current path is provided and one of the n number of power signals is in an on state; and activating one of the heating elements by the flow of the driving current.

7. The method of claim 6 further comprising:

providing each one of the n power signals to a corresponding one of the n number of power groups of heating elements, where each power group includes m number of odd heating elements in a first bank and m number of even heating elements in a second bank;

generating the bank signals to include a first bank signal and a second bank signal in alternating on and off states, the first bank signal being in an off state when the second bank signal is in an on state, and the second bank signal being in an off state when the first bank signal is an on state;

providing a first current path for flow of a first driving current when the first bank signal and one of the address signals are simultaneously in an on state;

causing the first driving current to flow through the first current path when the first current path is provided and one of the n number of power signals is in an on state;

activating one of the odd heating elements by the flow of the first driving current;

providing a second current path for flow of a second driving current when the second bank signal and one of the address signals are simultaneously in an on state;

causing the second driving current to flow through the second current path when the second current path is provided and one of the n number of power signals is in an on state; and activating one of the even heating elements by the flow of the second driving current.

8. The method of claim 6 wherein the step of generating m number of address signals further comprises sequentially turning on and off each one of the address signals, such that only one of the m number of address signals is in an on state at any one time.

9. The method of claim 6 wherein the step of generating n signals further comprises turning on and off one of the power signals only when an address signal is in an on state.

* * * * *